US009579891B2

(12) United States Patent
Hayashi et al.

(10) Patent No.: US 9,579,891 B2
(45) Date of Patent: Feb. 28, 2017

(54) LIQUID JETTING APPARATUS

(71) Applicant: Brother Kogyo Kabushiki Kaisha, Nagoya-shi, Aichi-ken (JP)

(72) Inventors: Hideki Hayashi, Nagoya (JP); Keita Hirai, Nagoya (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/995,674

(22) Filed: Jan. 14, 2016

(65) Prior Publication Data

US 2016/0207312 A1 Jul. 21, 2016

(30) Foreign Application Priority Data

Jan. 16, 2015 (JP) ..... 2015-007000

(51) Int. Cl.
*B41J 2/14* (2006.01)

(52) U.S. Cl.
CPC ..... *B41J 2/14233* (2013.01); *B41J 2/14072* (2013.01); *B41J 2002/14491* (2013.01)

(58) Field of Classification Search
CPC ..... B41J 2/14233; B41J 2/14072; B41J 2002/14491
See application file for complete search history.

(56) References Cited

U.S. PATENT DOCUMENTS

2007/0070128 A1* 3/2007 Inoue ..... B41J 2/161 347/68
2008/0218556 A1* 9/2008 Seto ..... B41J 2/14233 347/50

FOREIGN PATENT DOCUMENTS

| | | | |
|---|---|---|---|
| JP | H11-170505 | A | 6/1999 |
| JP | 2001-001548 | A | 1/2001 |
| JP | 2005-022190 | A | 1/2005 |
| JP | 2006-278579 | A | 10/2006 |

* cited by examiner

*Primary Examiner* — Geoffrey Mruk
(74) *Attorney, Agent, or Firm* — Banner & Witcoff, Ltd.

(57) ABSTRACT

A liquid jetting apparatus includes: a flow passage structure having nozzles aligned in a first direction, pressure chambers aligned in the first direction to correspond respectively to the nozzles, and a vibration film covering the pressure chambers; piezoelectric elements arranged on the vibration film to correspond respectively to the pressure chambers; and traces extending along a planar direction of the vibration film to correspond respectively to the piezoelectric elements. Each of the piezoelectric elements has a piezoelectric film arranged to cover the pressure chambers, and an individual electrode provided on the piezoelectric film to face a central portion of one of the pressure chambers and extending in a second direction intersecting the first direction. Within each area, of the vibration film, facing one of the pressure chambers, each of the traces extends from a connecting portion of the individual electrode along a third direction intersecting the second direction.

10 Claims, 10 Drawing Sheets

LIQUID JETTING APPARATUS

CROSS REFERENCE TO RELATED APPLICATION

The present application claims priority from Japanese Patent Application No. 2015-007000 filed on Jan. 16, 2015, the disclosures of which are incorporated herein by reference in its entirety.

BACKGROUND

Field of the Invention

The present teaching relates to liquid jetting apparatuses jetting liquid.

Description of the Related Art

Japanese Patent Application Laid-open No. 2005-22190 discloses an ink jet head as a liquid jetting apparatus which jets ink from a plurality of nozzles respectively. This ink jet head includes a flow passage formation substrate in which a plurality of pressure chambers are formed, a nozzle plate which is joined to the flow passage formation substrate and in which the plurality of nozzles are formed to communicate respectively with the plurality of pressure chambers, and a plurality of piezoelectric elements arranged on the flow passage formation substrate to correspond respectively to the plurality of pressure chambers.

Each of the plurality of pressure chambers has a rectangular shape and is aligned in the flow passage formation substrate along a predetermined direction. The plurality of pressure chambers are covered by a vibration film (an elastic film). Further, the plurality of pressure chambers are in respective communication with a manifold which is formed in the flow passage formation substrate to extend in an alignment direction of the pressure chambers. From this manifold, the ink is supplied respectively to the plurality of pressure chambers.

Each of the piezoelectric elements corresponding to one of the pressure chambers has a piezoelectric layer and two electrodes (an individual electrode and a common electrode) arranged to interpose the piezoelectric layer there between. The individual electrode of each of the piezoelectric elements also has a rectangular shape similar to the pressure chambers, and is arranged over a central portion of the corresponding pressure chamber. A trace (a leading electrode) is connected to a longitudinal end of the individual electrode. The trace extends from the end of the individual electrode up to the outer side of the corresponding pressure chamber along a longitudinal direction of the corresponding pressure chamber. If a voltage is applied to the piezoelectric layer of the piezoelectric element through the trace, then a flexural deformation occurs in the vibration film so as to exert a pressure on the ink inside the corresponding pressure chamber.

SUMMARY

In the ink jet head disclosed in Japanese Patent Application Laid-open No. 2005-22190, the traces are drawn out along the longitudinal direction of the pressure chambers from the ends of the individual electrodes arranged over the central portions of the pressure chambers. In this configuration, the traces are arranged on such areas of the vibration film covering the longitudinal ends of the pressure chambers, that is, on areas where the flexure is comparatively small. Therefore, when the vibration film undergoes the flexural deformation, it is less likely for electrical connection to fail between the traces and the ends of the individual electrodes.

However, in the ink jet head disclosed in Japanese Patent Application Laid-open No. 2005-22190, it is configured that the ink is supplied to the respective pressure chambers from the manifold formed in the flow passage formation substrate in a planar direction of the substrate. In contrary to this, it is also possible to adopt a configuration of forming liquid supply holes in the vibration film to communicate with the ends of the pressure chambers so as to supply the ink to the respective pressure chambers from a direction orthogonal to the substrate (see FIGS. 2 to 4 which will be explained in an embodiment). However, when the traces are drawn out from the ends of the individual electrodes in the longitudinal direction of the pressure chambers, if the liquid supply holes are arranged in end portions of the pressure chambers on the side of drawing out the traces, then it is necessary to arrange the traces to bypass the liquid supply holes. Because of this, the respective traces become longer, thereby increasing the traces' resistance.

It is an object of the present teaching to shorten the traces as much as possible while preventing a decrease in the reliability for connecting the individual electrodes and the traces due to the flexural deformation of the vibration film in a configuration in which the liquid supply holes are provided in the vibration film at portions facing the end portions of the pressure chambers on the side in which the traces are drawn out.

According to an aspect of the present teaching, there is provided a liquid jetting apparatus including: a flow passage structure having nozzles aligned in a first direction, pressure chambers aligned in the first direction to correspond respectively to the nozzles, and a vibration film covering the pressure chambers; piezoelectric elements arranged on the vibration film of the flow passage structure to correspond respectively to the pressure chambers; and traces extending along a planar direction of the vibration film of the flow passage structure to correspond respectively to the piezoelectric elements, wherein each of the pressure chambers is formed in a shape elongated in a second direction intersecting the first direction, liquid supply holes for supplying liquid respectively to the pressure chambers are formed in portions, of the vibration film, covering end portions of the pressure chambers on one side in the second direction respectively, each of the piezoelectric elements has a piezoelectric film arranged to cover one of the pressure chambers, and an individual electrode provided on the piezoelectric film to face a central portion of the one of the pressure chambers and extending in the second direction, each of the traces corresponding to one of the piezoelectric elements is superimposed on a connecting portion provided in an end portion, of the individual electrode, on the one side in the second direction to be electrically connected with the individual electrode, and within each area, of the vibration film, facing one of the pressure chambers and disposed on the one side in the second direction with respect to the connecting portion, each of the traces extends from the connecting portion toward an outer side of the area along a third direction intersecting the second direction.

According to the present teaching, the liquid supply holes are formed in the vibration film at portions facing the end portions of the pressure chambers on one side in the second direction (longitudinal direction). Further, the traces are connected to the connecting portions provided in end portions, of the individual electrodes arranged to overlap with the central portions of the pressure chambers, on the one side in the second direction. Further, the traces extend from the connecting portions in the third direction intersecting the second direction, on the one side with respect to the connecting portions of the individual electrodes in the second direction, within the area facing the pressure chambers. In this manner, by drawing out the traces from the connecting portions in the third direction intersecting the second direction, the traces need not be arranged to bypass the liquid supply holes and it is possible to shorten as much as possible the traces before being drawn out to the outer side of the pressure chambers.

Further if the traces are arranged in an area of the vibration film facing the pressure chambers, then due to a flexural deformation of the vibration film when a voltage is applied to the piezoelectric elements, the traces are displaced vertically to exert a force on the connecting portions of the individual electrodes such that the connecting portions and the traces are liable to be disconnected. In this regard, according to the present teaching, in each area, of the vibration film, on which the trace is arranged, and which is on the one side in the second direction (the longitudinal direction of the pressure chambers) with respect to the connecting portion of the individual electrode, flexural deformation is comparatively small. That is, by arranging the traces in the area where the flexural deformation is comparatively small within the area of the vibration film facing the pressure chambers, it is also possible to secure the reliability in the electrical connection between the connecting portions of the individual electrodes and the traces.

DESCRIPTION OF THE EMBODIMENT

Figure 1:
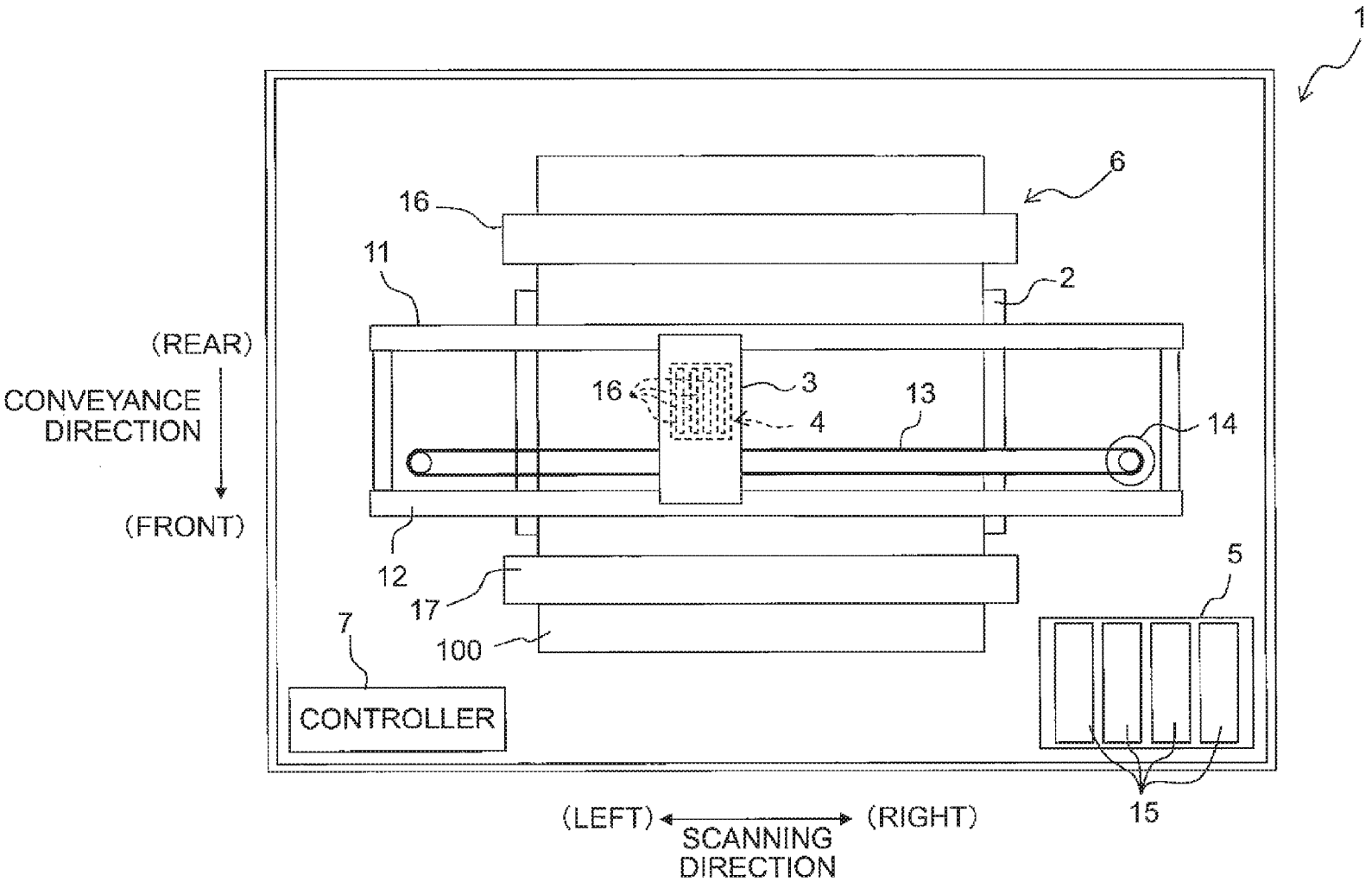
FIG. 1 is a schematic plan view of a printer according to an embodiment of the present teaching.

Next, a preferred embodiment of the present teaching will be explained. FIG. 1 is a schematic plan view of a printer according to the preferred embodiment of the present teaching. Further, the front, rear, left and right directions depicted in FIG. 1 are defined as "front", "rear", "left" and "right" of the printer, respectively. Further, the near side of the page of FIG. 1 is defined as "upper side" or "upside", while the far side of the page is defined as "lower side" or "downside". The following explanation will be made while appropriately using each directional term of the front, rear, left, right, upside, and downside.

<Schematic Configuration of Printer>

As depicted in FIG. 1, the ink jet printer 1 includes a platen 2, a carriage 3, an ink jet head 4, a cartridge holder 5, a transport mechanism 6, a controller 7, etc.

On the upper surface of the platen 2, there is carried a sheet of recording paper 100 which is a recording medium. The carriage 3 is configured to be movable reciprocatingly in a left-right direction (to be also referred to below as a scanning direction) along two guide rails 11 and 12 in a region facing the platen 2. An endless belt 13 is linked to the carriage 3, and a carriage drive motor 14 drives the endless belt 13 whereby the carriage 3 moves in the scanning direction.

The ink jet head 4 is mounted on the carriage 3 to be movable in the scanning direction together with the carriage 3. The ink jet head 4 includes four head units 16 aligning in the scanning direction. Each of the head units 16 includes a plurality of nozzles 24 (see FIGS. 2 to 4) formed in its lower surface (the surface on the far side of the page of FIG. 1).

The cartridge holder 5 is installed with ink cartridges 15 which retain inks of four colors (black, yellow, cyan, and magenta) and are respectively removable. The ink cartridges 15 are connected respectively with the corresponding head units 16 via undepicted tubes. The ink retained in each of the ink cartridges 15 is supplied to the head unit 16 via the tube. Each of the head units 16 of the ink jet head 4 jets the ink toward the recording paper 100 carried on the platen 2 from the plurality of nozzles 24 formed in its lower surface while moving in the scanning direction. Further, a description will be made later on a detailed configuration of the head units 16 of the ink jet head 4.

The transport mechanism 6 has two transport rollers 16 and 17 arranged to interpose the platen 2 therebetween in a front-rear direction. An undepicted transport motor synchronizes the two transport rollers 16 and 17 with each other and drives them. With the two transport rollers 16 and 17, the transport mechanism 6 transports the recording paper 100 carried on the platen 2 in the frontward direction (to be also referred to below as a conveyance direction).

The controller 7 is provided with a Centred Processing Unit (CPU), a Read Only Memory (ROM), a Random Access Memory (RAM), an Application Specific Integrated Circuit (ASIC) including various types of control circuits, etc. The controller 7 lets the CPU execute programs stored in the ROM to cause the ASIC to carry out various processes such as a process of printing on the recording paper 100 and the like. For example, in the printing process, based on a print command inputted from an external device such as a PC or the like, the controller 7 controls the head units 16 of the ink jet head 4, a carriage drive motor 14, the transport motor of the transport mechanism 6, and the like to print image and the like on the recording paper 100. More specifically, the controller 7 causes those members to alternately carry out an ink jet operation to jet the inks while moving the ink jet head 4 together with the carriage 3 in the scanning direction, and a transport operation to let the transport rollers 16 and 17 to transport the recording paper 100 in the conveyance direction by a predetermined length.

<Detailed Configuration of Ink Jet Head>

Figure 2:
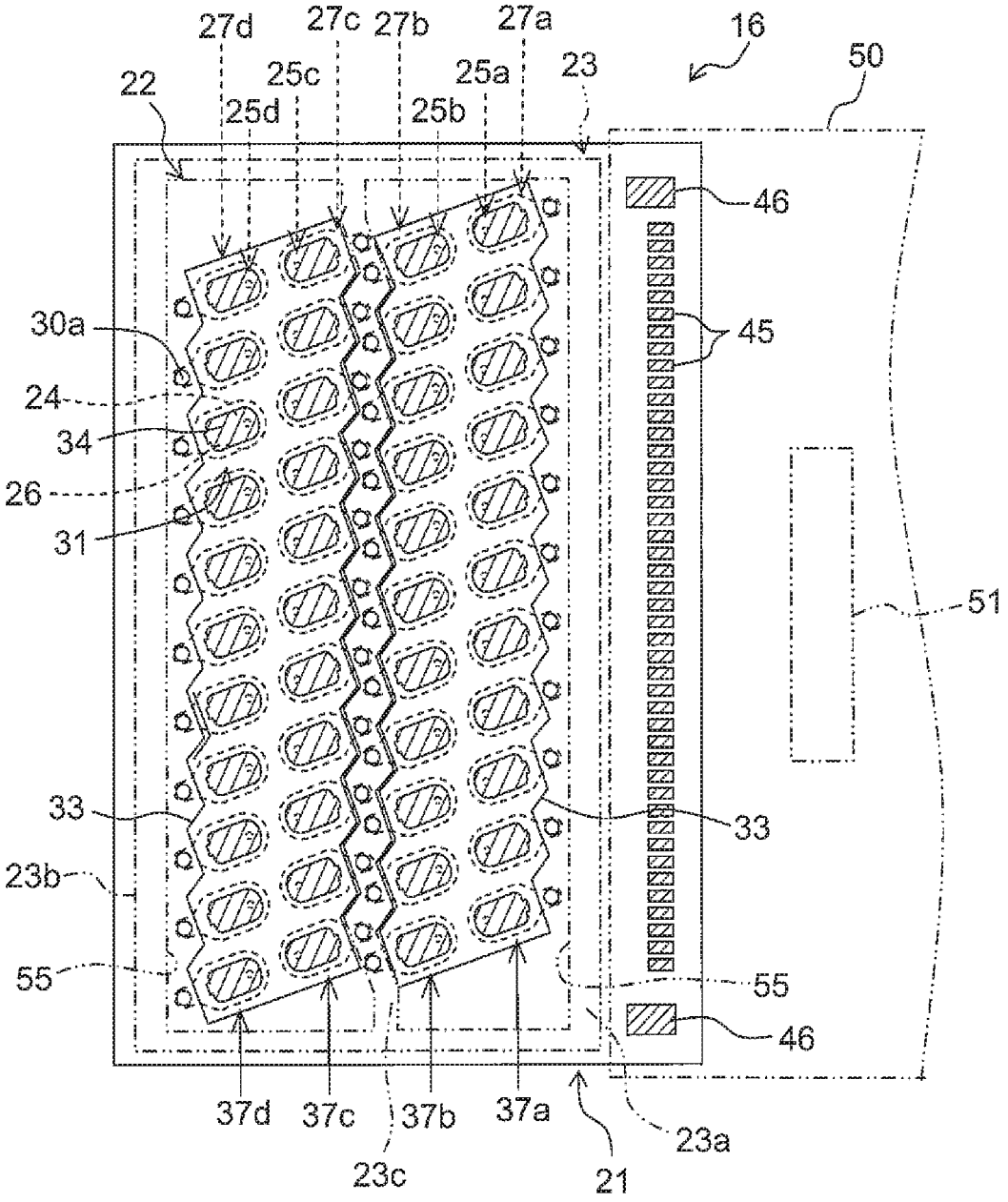
FIG. 2 is a plan view of a head unit of an ink jet head.
Figure 3:
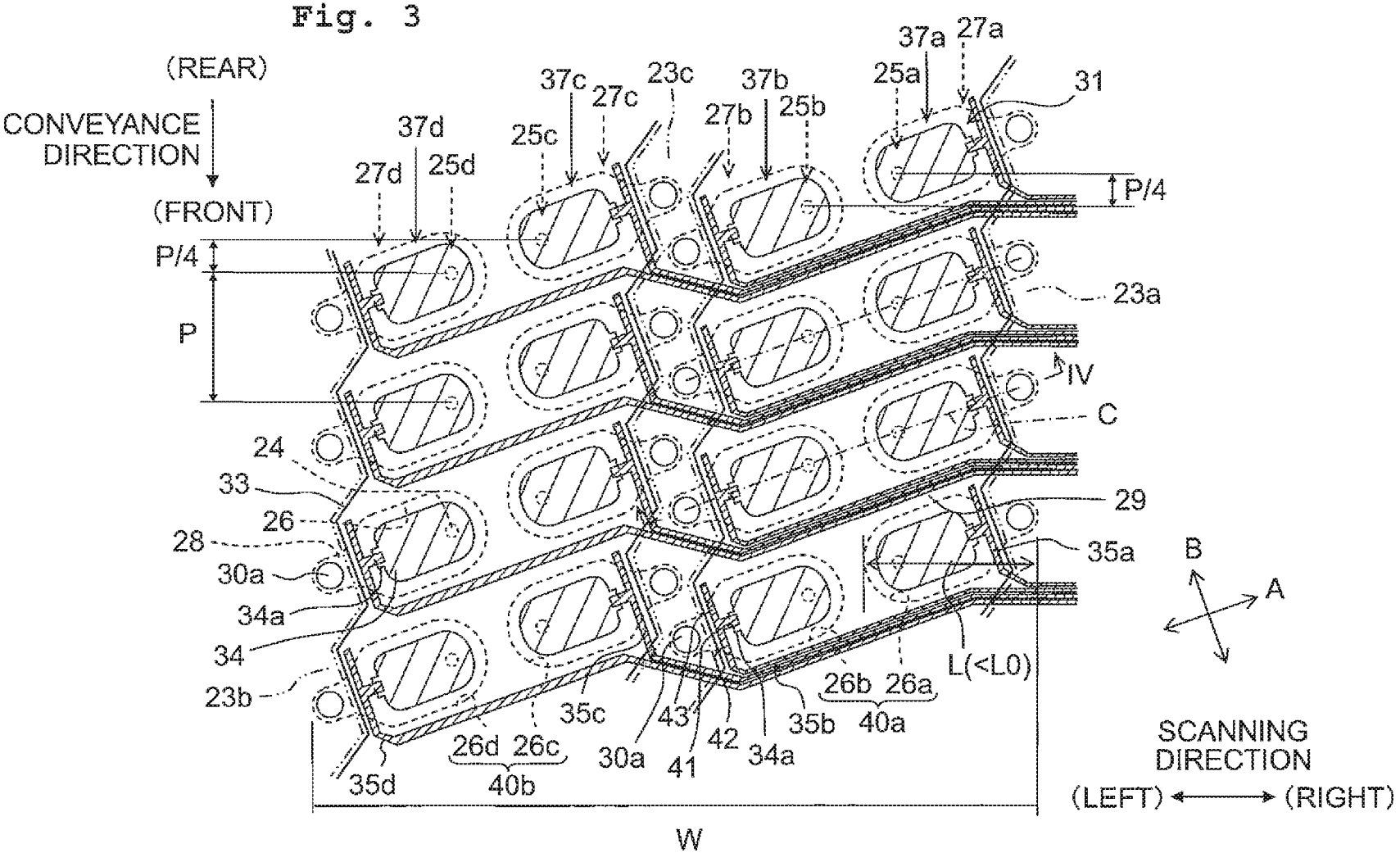
FIG. 3 is an enlarged view of a part of FIG. 2.
Figure 4:
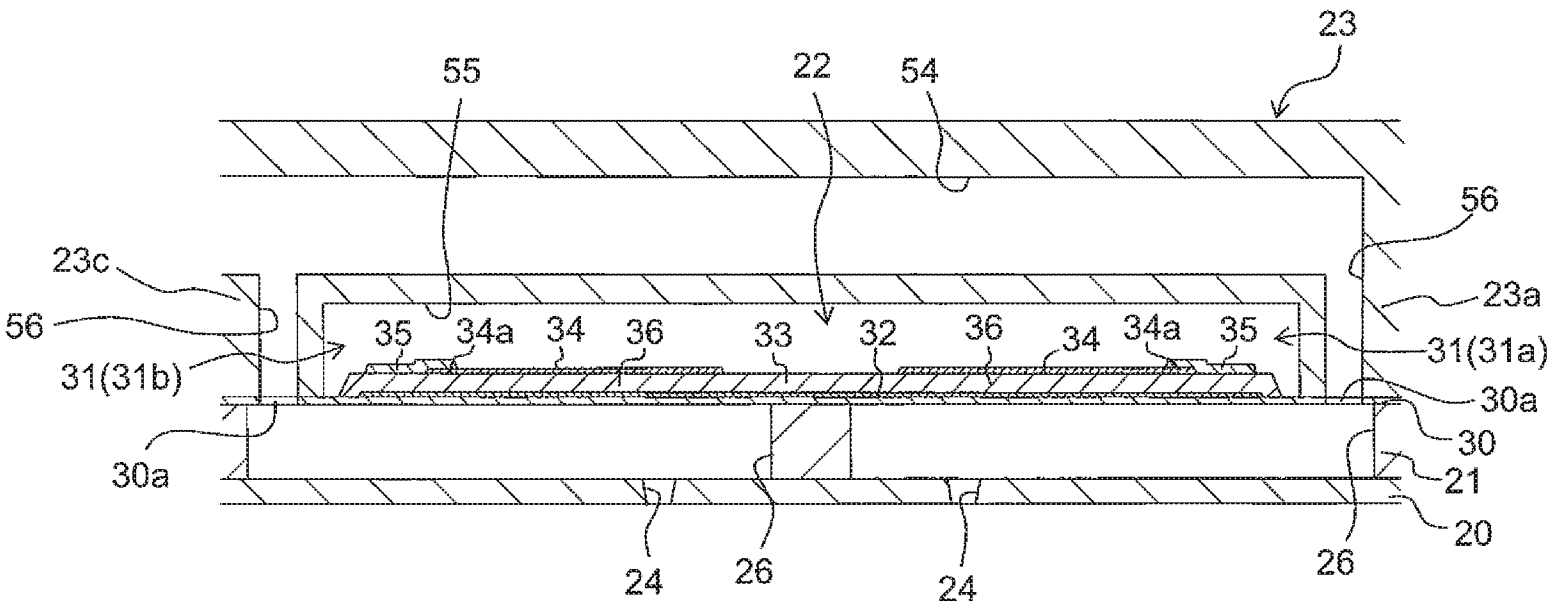
FIG. 4 is a cross-sectional view taken along the line IV-IV of FIG. 3.

Next, the head units 16 of the ink jet head 4 will be explained in detail. Further, because the four head units 16 have the same configuration with each other, one of them will be explained below. As depicted in FIGS. 2 to 4, the head unit 16 includes a nozzle plate 20, a flow passage substrate 21, a piezoelectric actuator 22, a reservoir formation member 23 (a protective member), etc. Further, in order to simplify FIG. 2, only a schematic illustration is made with two-dot chain lines for a driver IC 51 and the reservoir formation member 23 joined to the upper surface of the flow passage substrate 21.

<Nozzle Plate>

The nozzle plate 20 is, for example, formed of silicon or the like. As depicted in FIG. 4, a plurality of nozzles 24 are formed in the nozzle plate 20. As depicted in FIG. 2, the plurality of nozzles 24 are arrayed in the conveyance direction to form four nozzle rows 25 (25*a* to 25*d*) aligning in the scanning direction. In each of the nozzle rows 25, the plurality of nozzles 24 are arrayed at an arrayal pitch P. Further, as depicted in FIGS. 2 and 3, between the four nozzle rows 25*a* to 25*d*, the positions of the nozzles 24 deviate in steps of P/4 according to the conveyance direction, and the four nozzle rows 25*a* to 25*d* are arrayed in a so-called zigzag form. Further, the rightmost nozzle row 25*a* corresponds to the "first nozzle row" of the present teaching. The second nozzle row 25*b* from the right corresponds to the "second nozzle row" of the present teaching. The third nozzle row 25*c* from the right corresponds to the "third nozzle row" of the present teaching. The leftmost nozzle row 25*d* corresponds to the "fourth nozzle row" of the present teaching.

<Flow Passage Member>

The flow passage substrate 21 is a substrate of silicon single crystal. In the flow passage substrate 21, a plurality of pressure Chambers 26 are formed in respective communication with the plurality of nozzles 24. Each of the pressure chambers 26 has an approximately oval planar shape elongated in the scanning direction. The plurality of pressure chambers 26 are arrayed in the conveyance direction in accordance with the arrayal of the plurality of nozzles 24 to form four pressure Chamber rows 27 (27*a* to 27*d*) aligning in the scanning direction. Further, the rightmost pressure chamber row 27*a* corresponds to the "first pressure chamber row" of the present teaching. The second pressure chamber row 27*b* from the right corresponds to the "second pressure chamber row" of the present teaching. The third pressure chamber row 27*c* from the right corresponds to the "third pressure chamber row" of the present teaching. The leftmost pressure chamber row 27*d* corresponds to the "fourth pressure chamber row" of the present teaching. Further, the layered body of the aforementioned nozzle plate 20 and flow passage substrate 21 corresponds to the "flow passage structure" of the present teaching.

Each of the pressure chambers 26 is arranged obliquely for its longitudinal direction to be parallel to a direction A which respectively intersects the front-rear direction (the "first direction" of the present teaching) and the left-right direction. Further, the direction A, which is the longitudinal direction of the pressure chambers 26, corresponds to the "second direction" of the present teaching. An end portion of each of the pressure chambers 26 on one side according to the direction A (a left end portion for the pressure chamber rows 27*a* and 27*c* while a right end portion for the pressure chamber rows 27*b* and 27*d*) overlaps with the corresponding nozzle 24 in an up-down direction. That is, in the two pressure chamber rows 27*a* and 27*b* on the right, the nozzles 24 are in respective communication with the inner end portions of the pressure chambers 26. Further, in the two pressure Chamber rows 27*c* and 27*d* on the left, in the same manner, the pressure chambers 26 are also in respective communication with the nozzles 24. On the other hand, end portions of the pressure chambers 26 on the other side according to the direction A (end portions 28 on the far side from the nozzles 24) are smaller in width according to a transverse direction (a direction B orthogonal to the direction A) than central portions of the pressure chambers 26. Further, the end portions 28 mentioned above on the other side are formed into such a tapered shape that the closer to the end along the direction A, the narrower in width.

Further, in the two pressure chamber rows 27*a* and 27*b* on the right, two of the pressure chambers 26 (26*a* and 26*b*) are arranged on one straight line parallel to the direction A. Further, the expression "two of the pressure chambers 26 are arranged on one straight line" means that the two pressure chambers 26 are arranged with their central line C, extending in their longitudinal direction, being on an identical straight line. Further, a group formed of two pressure chambers 26*a* and 26*b* will be referred to below as a "first proximal pressure Chamber group 40*a*". Likewise, in two of the pressure chamber rows 27*c* and 27*d* on the left, two of the pressure chambers 26 (26*c* and 26*d*) are also arranged on one straight line parallel to the direction A to constitute a group formed of the two pressure chambers 26*c* and 26*d* (a "second proximal pressure chamber group 40*b*"). As described above, in this embodiment, in one proximal pressure chamber group 40, as viewed in the direction A, across a common wall separating two pressure chambers 26, two nozzles 24 (end portions of the pressure chambers 26 on one side) are arranged to face each other and, further across these members from the outer side, there are arranged the end portions 28 of two pressure chambers 26 formed into the tapered shape on the other side.

Figure 5:
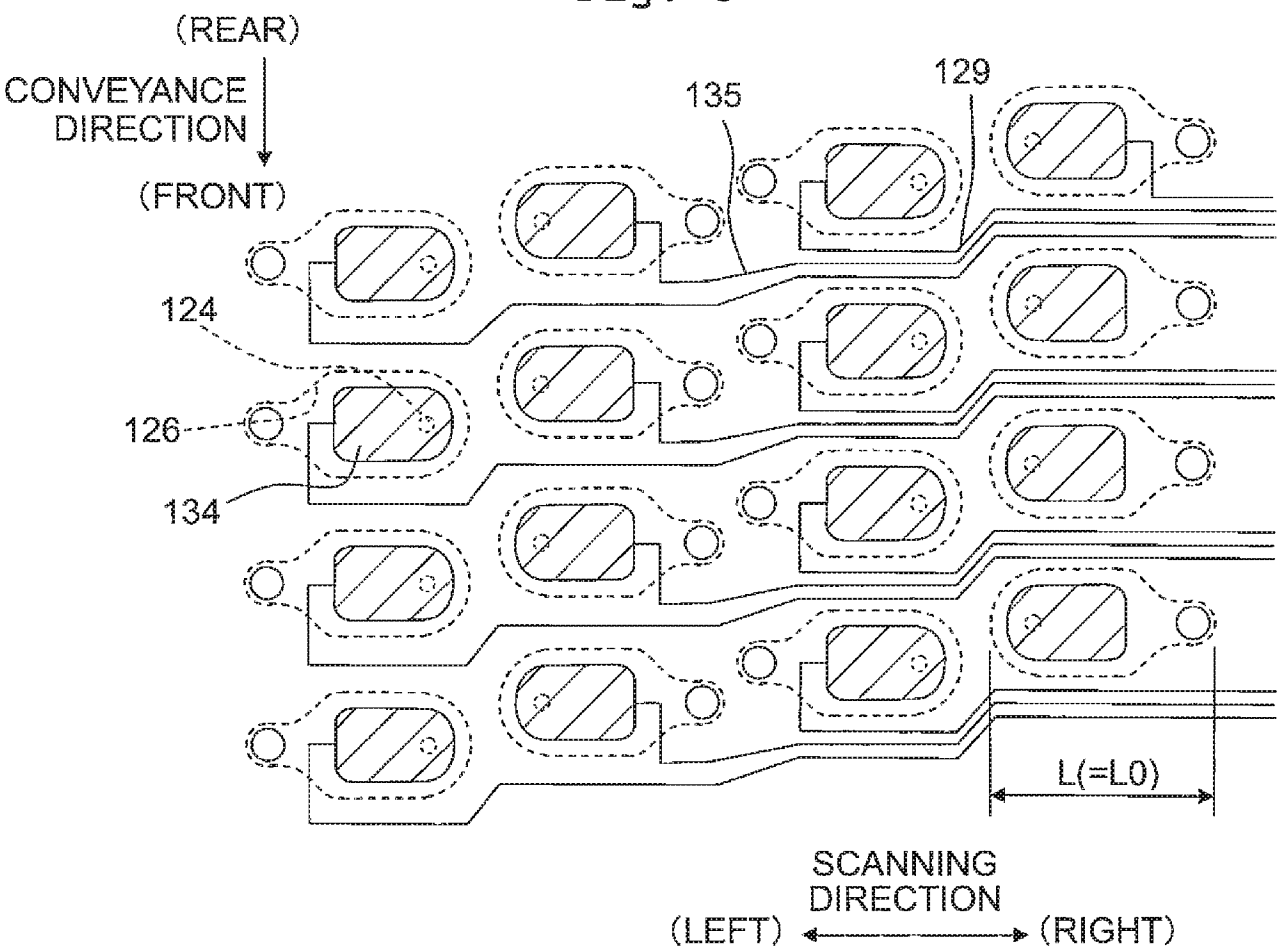
FIG. 5 depicts an arrangement of a plurality of pressure chambers with their longitudinal direction along a left-right direction.

The following is the reason of arranging each of the pressure chambers 26 for its longitudinal direction to be parallel to the direction A. FIG. 5 depicts an arrangement of a plurality of pressure chambers 126 as the pressure chambers 126 are arranged with their longitudinal direction parallel to the scanning direction. First, as a premise, for one jet element jetting the ink as depicted in FIG. 5, its nozzle 124, pressure Chamber 126 and individual electrode 134 are supposed to be the same in shape, size and mutual positional relation as the nozzle 24, pressure chamber 26 and individual electrode 34 in the present embodiment. In the left-right direction, the length L of each pressure chamber 126 is equal to its longitudinal length (L0). In contrast to this, as depicted in FIG. 3, if the pressure chambers 26 are inclined for heir longitudinal direction to be parallel to the direction A, then in accordance with the inclination angle, the length L of the pressure chambers 26 becomes shorter in the left-right direction. Therefore, the four pressure chamber rows 27, as a whole, have a smaller width W. Hence, the flow passage substrate 21 also becomes smaller in size. The flow passage substrate 21 is formed of silicon single crystal; thus, it is possible to lower the cost for manufacturing the flow passage substrate 21 by increasing the number of flow passage substrates 21 which can be cut out of one silicon wafer and, furthermore, it is effective to use such flow passage substrates 21 for downsizing the printer as a whole.

Further, the two pressure chambers 26 constituting one proximal pressure chamber group 40 are arranged to align on one straight line along the direction A. In this configuration, there is an interspace 29 having a certain width extending in the direction A, between two proximal pressure chamber groups 40 adjacent in the conveyance direction. As will be described later on, one of a plurality of traces 35 is drawn out from a piezoelectric element 31 corresponding to the pressure chamber 26, and arranged in one interspace 29 mentioned above. Further, as depicted in FIG. 2, a plurality of drive contact portions 45 are arranged on the upper surface of a right end portion of the flow passage substrate 21, to connect respectively with the plurality of traces 35.

The flow passage substrate 21 has a vibration film 30 formed on its upper surface to cover the plurality of pressure chambers 26. The vibration film 30 is formed by oxidizing or nitriding a surface of a silicon substrate. In such a part of each of the pressure chambers 26 as to face the tapered end portion 28, an ink supply hole 30*a* (the liquid supply hole of the present teaching) is formed to penetrate through the vibration film 30.

As depicted in FIG. 3, there is an overlapped positional relation as viewed from the conveyance direction between the end portions 28 (left end portions) of the pressure chambers 26*b* belonging to the pressure chamber row 27*b*, and the end portions 28 (right end portions) of the pressure chambers 26*c* belonging to the pressure chamber row 27*c*. Therefore, there is also an overlap as viewed from the conveyance direction between the ink supply holes 30*a* in communication with the end portions 28 of the pressure chambers 26*b*, and the ink supply holes 30*a* in communication with the end portions 28 of the pressure chambers 26*c*. By virtue of this, because it is possible then to narrow the area between the two pressure chamber rows 27*b* and 27*c* (between the first proximal pressure chamber group 40*a* and the second proximal pressure chamber group 40*b*), it is possible to further downsize the flow passage substrate 21 in the scanning direction. Further, in this embodiment, because the end portions 28 of the pressure chambers 26 are formed in a tapered shape, it is possible to arrange the corresponding end portions 28 to be close to each other between any two of the pressure chambers 26*b* and 26*c* adjacent in the scanning direction such that it becomes easy to arrange the two ink supply holes 30*a* to overlap with each other as viewed from the conveyance direction.

From the aftermentioned reservoir formation member 23, the inks are supplied to the respective pressure chambers 26 via the ink supply holes 30*a* of the vibration film 30. Then, if the piezoelectric actuator 22, which will be described next, applies a jet energy to the inks in any of the pressure chambers 26, then liquid drops of the ink are jetted from the nozzles 24 in communication with those pressure chambers 26.

<Piezoelectric Actuator>

As depicted in FIGS. 2 to 4, the piezoelectric actuator 22 serves to apply the jet energy to the inks in the plurality of pressure chambers 26 for the respective nozzles 24 to jet the inks. The piezoelectric actuator 22 has the plurality of piezoelectric elements 31 arranged on the upper surface of the vibration film 30 of the flow passage substrate 21 to correspond respectively to the plurality of pressure chambers 26.

A configuration of the piezoelectric elements 31 will be explained. As depicted in FIG. 4, two common electrodes 32 are formed on the upper surface of the vibration film 30 to correspond respectively to the two pressure chamber rows 27*a* and 27*b* on the right and the two pressure chamber rows 27*c* and 27*d* on the left. Each common electrode 32 is provided commonly for the plurality of pressure chambers 26 constituting two of the pressure chamber rows 27. However, the common electrodes 32 do not overlap with the end portions 28 of the respective pressure chambers 26. Therefore, the two common electrodes 32 are separated, in the left-right direction, in a central area of the vibration film 30 where the plurality of ink supply holes 30*a* are arranged. The common electrodes 32 are electroconductive films made of platinum (Pt), for example. Further, while illustration is omitted, the two common electrodes 32 are in mutual electrical conduction in an area outside of the four pressure chamber rows 27.

Further, two piezoelectric bodies 33 are formed on the upper surface of the vibration film 3C) to cover the two common electrodes 32 respectively. Each of the piezoelectric bodies 33 is arranged across the plurality of pressure Chambers 26 constituting two of the pressure chamber rows 27. In the same manner as the common electrodes 32, each of the piezoelectric bodies 33 is arranged to avoid the plurality of ink supply holes 30*a* of the vibration film 30, and its edge portions on the opposite sides in the scanning direction have a zigzag shape. The piezoelectric bodies 33 are formed of, for example, a piezoelectric material composed primarily of lead zirconate titanate (PZT) which is a mixed crystal of lead titanate and lead zirconate. Alternatively, the piezoelectric bodies 33 may be formed of non-lead-based piezoelectric material in which no lead is contained.

The plurality of individual electrodes 34 are formed on the upper surface of each of the piezoelectric bodies 33 to face the plurality of pressure chambers 26, respectively. Each of the individual electrodes 34 has an approximately oval shape one size smaller than the pressure chamber 26. Further, each of the individual electrodes 34 has its longitudinal orientation in conformity with the longitudinal direction of the pressure chamber 26 (the direction A) in a central portion of the corresponding pressure chamber 26. In longitudinal end portions thereof on the side of the ink supply holes 30*a*, connecting portions 34*a*, are formed to connect with the traces 35 which will be described later on. The connecting portions 34*a* are arranged on the central lines C of the pressure chambers 26. Further, the individual electrodes 34 are formed of iridium (1*r*), for example.

In the above configuration, for one pressure chamber 26, one piezoelectric element 31 is constructed by the respective constituents composed of the common electrode 32, piezoelectric body 33 and individual electrode 34 facing the pressure chamber 26. In other words, one common electrode 32, and one piezoelectric body 33, which are linked en suite, are shared between the plurality of piezoelectric elements 31. The plurality of piezoelectric elements 31 are formed into one piezoelectric actuator 22. Further, such parts of the piezoelectric bodies 33 as the piezoelectric films interposed between the common electrodes 32 and the individual electrodes 34 (referred to as active portions 36) are polarized respectively downward in their thickness direction, that is, in such a direction as from the upper individual electrodes 34 toward the lower common electrodes 32.

Further, the plurality of piezoelectric elements 31 are arrayed in the conveyance direction to follow the arrayal of the plurality of pressure chambers 26. By virtue of this, the plurality of piezoelectric elements 31 form four piezoelectric element rows 37*a* to 37*d* aligning in the scanning direction to correspond respectively to the four pressure chamber rows 27*a* to 27*d*.

The above plurality of piezoelectric elements 31 are connected respectively with the plurality of traces 35 for supplying a drive signal thereto. The plurality of traces 35 are respectively drawn out on the upper surfaces of the piezoelectric bodies 33 from the aforementioned connecting portions 34*a* to the outer side of the pressure chambers 26, and extend rightward toward the drive contact portions 45 of the flow passage substrate 21. Further, in the area to the right of the piezoelectric body 33 on the right and in the area between the two piezoelectric bodies 33, no piezoelectric body 33 is arranged whereas the traces 35 are arranged on the vibration film 30. The traces 35 are formed of a different material from the individual electrodes 34. The traces 35 are formed through sputtering, for example, by using a metallic material such as gold (Au), aluininum (Al) or the like which has a low electrical resistivity. A detailed description will be made later on a configuration of the traces 35.

As depicted in FIG. 2, the plurality of drive contact portions 45 and two around contact portions 46 are arranged on the upper surface of a right end portion of the flow passage substrate 21. The plurality of drive contact portions 45 align in the conveyance direction. Further, the two ground contact portions 46 are arranged respectively on the opposite sides of the drive contact portions 45 in their alignment direction. The drive contact portions 45 are electrically connected with the individual electrodes 34 of the piezoelectric elements 31 via the traces 35. Further, while illustration is omitted, the ground contact portions 46 are connected with the common electrodes 32 of the plurality of piezoelectric elements 31.

As depicted in FIG. 2, (one end portion of) the COF 50 is joined to the respective contact portions 45 and 46. The driver IC 51 is mounted on a middle portion of the COF 50, and the other end portion of the CM; 50 is connected to the controller 7 of the printer 1 (see FIG. 1) In this case, the drive contact portions 45 are connected with output terminals of the driver IC 51 while the two ground contact portions 46 are connected with a ground terminal (not depicted) of the CM; 50.

Based on a control signal sent in from the controller 7, the driver IC 51 generates and outputs a drive signal for driving the respective piezoelectric elements 31. The outputted drive signal is inputted to the drive contact portions 45 via some traces of the COF 50 and, furthermore, supplied to the individual electrodes 34 of the respective piezoelectric elements 31 via the traces 35. The individual electrodes 34 change between a predetermined drive potential and the ground potential. During this period, the common electrodes 32 connected with the ground contact portions 46 are constantly kept at the ground potential.

Now, an explanation will be made on an operation of each of the piezoelectric elements 31 when supplied with the drive signal from the driver IC 51. Without being supplied with the drive signal, the individual electrodes 34 are at the ground potential, that is, at the same potential as the common electrodes 32. From this state, if the drive potential is applied to any one of the individual electrodes 34, then due to the difference between itself and the common electrode 32 arranged facing it, an electric field acts on the active portion 36 of the piezoelectric body 33 in its thickness direction. In this case, because the polarization direction conforms with the direction of the electric field, the active portion 36 extends in the thickness direction and thus contracts in the planar direction. Along with the contraction deformation of this active portion 36, the vibration film 30 bows to project toward the pressure chamber 26. By virtue of this, the volume of the pressure chamber 26 decrease, thereby jetting liquid drops of the ink from the nozzle 24.

Next, referring primarily to FIG. 3, an explanation will be made on a detailed configuration of the traces 35. As depicted in FIG. 3, end portions of the traces 35 are superimposed from above on the connecting portions 34*a* to connect electrically thereto. The respective traces 35 extend, from the connecting portions 34*a*, along the direction B (a transverse direction of the pressure chambers 26) orthogonal to the longitudinal direction of the pressure chambers 26, in an area on the outer side of the pressure chambers 26 according to the longitudinal direction (the direction A). More specifically, each of the traces 35 has three parts 41 to 43, wherein the first part 41 extends along the direction A from the connecting portion 34*a*, the second part 42 and the third part 43 extend along the direction B from the first part 41.

The first parts 41 of the traces 35 extend from the connecting portions 34*a* to middle portions of the tapered end portions 28 of the pressure chambers 26. More specifically, each of the first parts 41 extends to a central point position of a line segment linking the connecting portion 34*a* and the ink supply hole 30*a*. Each of the second parts 42 extends frontward along the direction B (the transverse direction of the pressure chamber 26) from the leading portion of the first part 41 up to the outer side of the pressure chamber 26. Each of the third parts 43 and the corresponding second part 42 are arranged symmetrically with respect to the first part 41 to extend rearward along the direction B from the leading end of the first part 41 up to the outer side of the pressure chamber 26. That is, the second parts 42 and the third parts 43 are arranged to traverse the narrow end portions 28 of the pressure chambers 26 in the transverse direction.

As depicted in FIG. 3, each of the tapered end portions 28 of the pressure chambers 26 is shaped with its outline being a combination of curved lines. In this embodiment, from the base portion of each of the end portions 28, a curved line convex to the outer side of the pressure chamber 26 connects respectively with curved lines convex to the inter side of the pressure chamber 26 from the side of the ink supply hole 30*a*. Further, the inward convex curved lines are connected to close the leading end of the end portion 28. That is, the outline (edge geometry) of the end portions 28 has a symmetrical shape with respect to the central line in the direction A, and has a one-sided half part of the S-shape in the vicinity of the base portion. In this case, the second part 42 and the third part 43 of each of the traces 35 are overlapped in the part convex to the outer side of the pressure chamber 26 or in the part convex to the inner side of the pressure chamber 26 or in the part combining the two parts. Any of the above cases causes a smaller flexural deformation of the vibration film 30 as compared to the case where the end portion 28 has such a shape as linearly tapered from the base end toward leading end thereof. Therefore, it is less likely to break the traces 35 up and/or to damage the connecting portions 34*a*.

As explained earlier on, one proximal pressure chamber group 40 (40*a* and 40*b*) is constituted by two pressure chambers 26 adjacent in the direction A. Each of the second parts 42 of the traces 35 extends toward the interspace 29 with a certain width extending along the direction A between the two proximal pressure chamber groups 40 (40*a* and 40*b*) aligning in the conveyance direction. Then, the traces 35 extend through the interspaces 29 linearly along the direction A toward the drive contact portions 45.

Further, the traces 35*b*, 35*c* and 35*d* of the three piezoelectric element rows 37*b*, 37*c* and 37*d* on the left are arranged respectively in the interspaces 29 on the right, whereas only the traces 35*d* of the one piezoelectric element row 37*d* are arranged in the interspaces 29 on the left. Further, because the interspaces 29 on the left have sufficient arrangement space, as depicted in FIG. 3, the traces 35*d* are wider than those in the interspaces 29 on the right.

In the embodiment explained above, the traces 35 connected to the connecting portions 34*a* of the individual electrodes 34 extend from the connecting portions 34*a* to the outer side of the pressure chambers 26 along the transverse direction of the pressure chambers 26 (the direction B). By virtue of this, the traces 35 need not be arranged to bypass the ink supply holes 30*a* such that it is possible to shorten as much as possible the traces 35 before being drawn out to the outer side of the pressure chambers 26.

Further, when the voltage is applied to the piezoelectric elements 31, the vibration film 30 undergoes a flexural deformation to vertically displace the parts where the traces 35 are formed. By virtue of this, a stress is applied to the connecting portions 34*a* of the individual electrodes 34 such that the connecting portions 34*a* and the traces 35 are liable to disconnection. In this regard, the end portions 28 of the pressure chambers 26 in this embodiment are smaller in width than the central portions of the pressure chambers 26 and, furthermore, have a tapered shape. In this region, the vibration film 30 undergoes a comparatively smaller flexural deformation. Therefore, the connecting portions 34*a* and the traces 35 are less likely to be electrically disconnected, thereby improving the reliability in electrical connection.

Further, in this embodiment, the traces 35 have the first parts 41 and the second parts 42, and the second parts 42 extend to the outer side of the pressure chambers 26 along the direction B (the transverse direction of the pressure chambers 26). In this configuration, the traces 35 are arranged to traverse the edges of the pressure chambers 26 in places farther away from the connecting portions 34*a* on the outer side of the pressure chambers 26 in the longitudinal direction. In this case, as the positions intersecting the edges are farther away from the connecting portions 34*a* in the longitudinal direction of the pressure chambers 26, there is a further decrease in the stress applied to the connecting portions 34*a* due to the flexural deformation of the vibration film 30. Therefore, it is possible to further improve the reliability in the electrical connection between the connecting portions 34*a* and the traces 35. Further, the traces 35 per se are less likely to be broken.

However, if the second parts 42 are arranged within the regions facing the pressure chambers 26 to extend in the direction B orthogonal to the direction A (the longitudinal direction of the pressure chambers 26), then the vibration film 30 cannot deform symmetrically on the opposite sides with respect to a straight line (the central line C) being parallel to the longitudinal direction of each of the pressure chamber 26 and passing through the connecting portion 34*a*. More specifically, if the second parts 42 are arranged only on one side (in the front parts) with respect to the central lines C, then a difference in magnitude is subject to occurrence in the deformation between the front parts, and the rear parts where the second parts 42 are not arranged, thereby causing the vibration film 30 to undergo a distorted deformation. Thereby, the jet property is liable to variation and/or a great force is liable to act on the connecting portions 34*a*.

In this embodiment, therefore, the second parts 42 and the third parts 43 are arranged symmetrically with respect to the first parts 41. By virtue of this, the vibration film 30 undergoes a nearly symmetrical deformation on the opposite sides with respect to each of the central lines C, thereby suppressing the force arising from non-uniform deformation and acting on the connecting portions 34*a*. Further, there is also a decrease in the variation of the jet property. Further, the third parts 43 are connected with the second parts 42 via the first parts 41. Therefore, the vibration film 30 is improved in the symmetry of deformation with respect to the central lines C, thereby further suppressing the force acting on the connecting portions 34*a* and the variation of the jet property also further decreases.

Further, in this embodiment, one proximal pressure chamber group 40 is constituted by arranging two pressure chambers 26 belonging respectively to two pressure chamber rows 27, on a straight line containing the central line C of the pressure chambers 26, parallel to the direction A. Then, the trace 35 extends linearly along the direction A through the interspace between two proximal pressure chamber groups 40 adjacent in the conveyance direction. In this manner, in this embodiment, it is possible to reduce the curvature of the traces 35 drawn out from the piezoelectric element rows 37 positioned on the far side from the drive contact portions 45, thereby restraining the trace resistance from increasing.

Further, when the pressure chambers 126 are arranged as depicted in FIG. 5, the interspace 129 between any two pressure chambers 126 adjacent in the conveyance direction deviates in position in the conveyance direction between the two pressure chamber rows. Therefore, when traces 135 are arranged in the above interspaces 129, the traces 135 are inflected between the two pressure chamber rows such that the trace resistance increases at that rate.

<Reservoir Formation Member>

As depicted in FIGS. 2 to 4, the reservoir formation member 23 is joined to the upper surface of the flow passage substrate 21 to cover the plurality of piezoelectric elements 31. A reservoir 54 is formed in an upper portion of the reservoir formation member 23. The reservoir 54 is connected with the ink cartridges 15 depicted in FIG. 1 through undepicted tubes or the like, and supplied with the inks of predetermined colors. Two recesses 55 are formed in a lower portion of the reservoir formation member 23. The recess 55 on the right internally contains and covers the two piezoelectric element rows 37*a* and 37*b* while the recess 55 on the left internally contains and covers the two piezoelectric element rows 37*c* and 37*d*. Each of the recesses 55 is arranged to let its bottom face the piezoelectric element rows 37 across some interspace. The two recesses 55 are defined by three walls 23*a*, 23*b* and 23*c* aligning in the scanning direction. The right wall 23*a* is joined to and overlapped with a leading end portion of the end portion 38 of each of the pressure chambers 26*a* while the left wall 23*b* is joined to and overlapped with a leading end portion of the end portion 38 of each of the pressure chambers 26*d*. The central wall 23*c* is joined to and overlapped with leading end portions of the end portions 38 of every two of the pressure chambers 26*b* and 26*c*. A plurality of ink supply flow passages 56 are formed in the respective walls 23*a*, 23*b* and 23*c* to allow respective communication between the reservoir 54 and the ink supply holes 30*a*. The inks in the reservoir 54 are supplied to the respective pressure chambers 26 via the ink supply flow passages 56, and the ink supply holes 30*a* of the vibration film 30.

The reservoir formation member 23 has a function of a protective member to protect the plurality of piezoelectric elements 31, as well as a function to temporarily retain the inks supplied to the plurality of pressure chambers 26. Further, the reservoir formation member 23 also has a function of a reinforcing member to raise the rigidity of the flow passage substrate 21 by being joined to the flow passage substrate 21. Further, the reservoir formation member 23 corresponds to the "junction member" of the present teaching.

Here, as described above, because the respective pressure chambers 26 are arranged with their longitudinal direction being inclined from the scanning direction to be parallel to the direction A, one of the recesses 55 of the reservoir formation member 23 has a smaller width according to the scanning direction. That is, the walls 23*a*, 23*b* and 23*c* of the reservoir formation member 23 are spaced at shorter distances. Hence, the reservoir. Conflation member 23 raises the effect of reinforcing the flow passage substrate 21.

Further, when the reservoir formation member 23 is attached to the flow passage substrate 21 with an adhesive, the surplus adhesive is liable to flow onto the active portions 36 of the piezoelectric elements 31. If the adhesive adheres to the active portions 36, then deformation of the active portions 36 are subject to impediment. In this regard, because the traces 35 in this embodiment extend along the transverse direction of the pressure chambers 26 in the end portions 28 of the respective pressure chambers 26 on the side of the ink supply holes 30*a*, the surplus adhesive is restrained from flowing toward the active portions 36 of the piezoelectric elements 31. Further, because the second parts 42 and the third parts 43 of the trace 35 are arranged to traverse the end portions 28 of the pressure chambers 26, in other words, arranged parallel to the respective walls 23*a*, 23*b* and 23*c* of the reservoir formation member 23, the surplus adhesive is restrained reliably from further flowing onto the active portions 36.

Next, an explanation will be made on a few modifications Which modify the above embodiment in various ways. However, the same reference numerals or alphanumerals are assigned to the components identical or similar in configuration to those in the above embodiment, and any explanation therefor will be omitted as appropriate.

1] The traces 35 are not limited to the configuration of the above embodiment where their parts are drawn out from the individual electrodes 34 in the region facing the pressure chambers 26.

Figure 6:
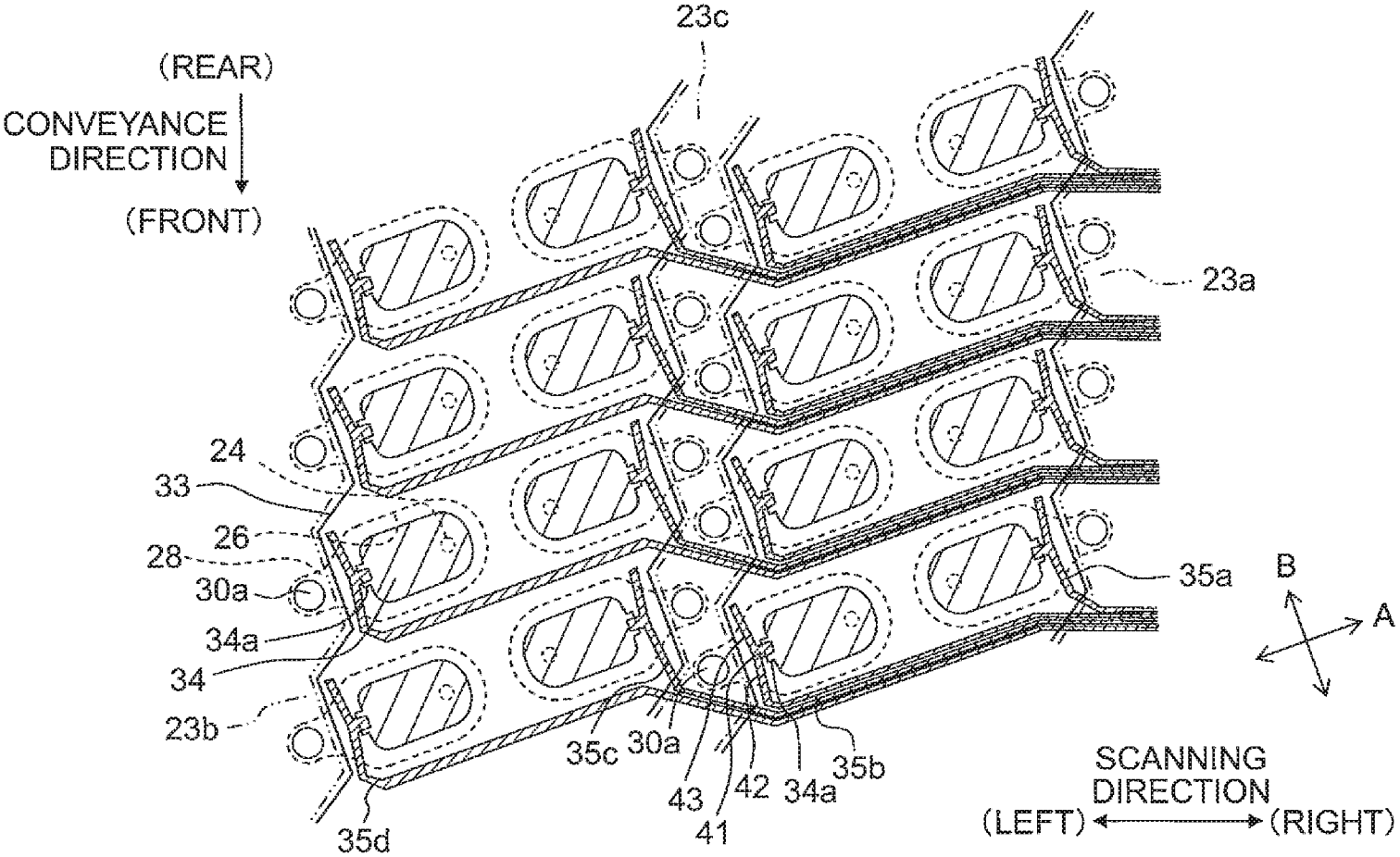
FIG. 6 is a partially enlarged plan view of a head unit according to a modification of the embodiment.

(a) In the above embodiment, the second parts 42 and the third parts 43 of the traces 35 extend in the transverse direction of the pressure chambers 26 (the direction B) orthogonal to the longitudinal direction of the pressure chambers 26 (the direction A). As depicted in FIG. 6, however, the second parts 42 and the third parts 43 may extend in a direction intersecting the longitudinal direction of the pressure chambers 26 at an angle other than 90 degrees.

Figure 7:
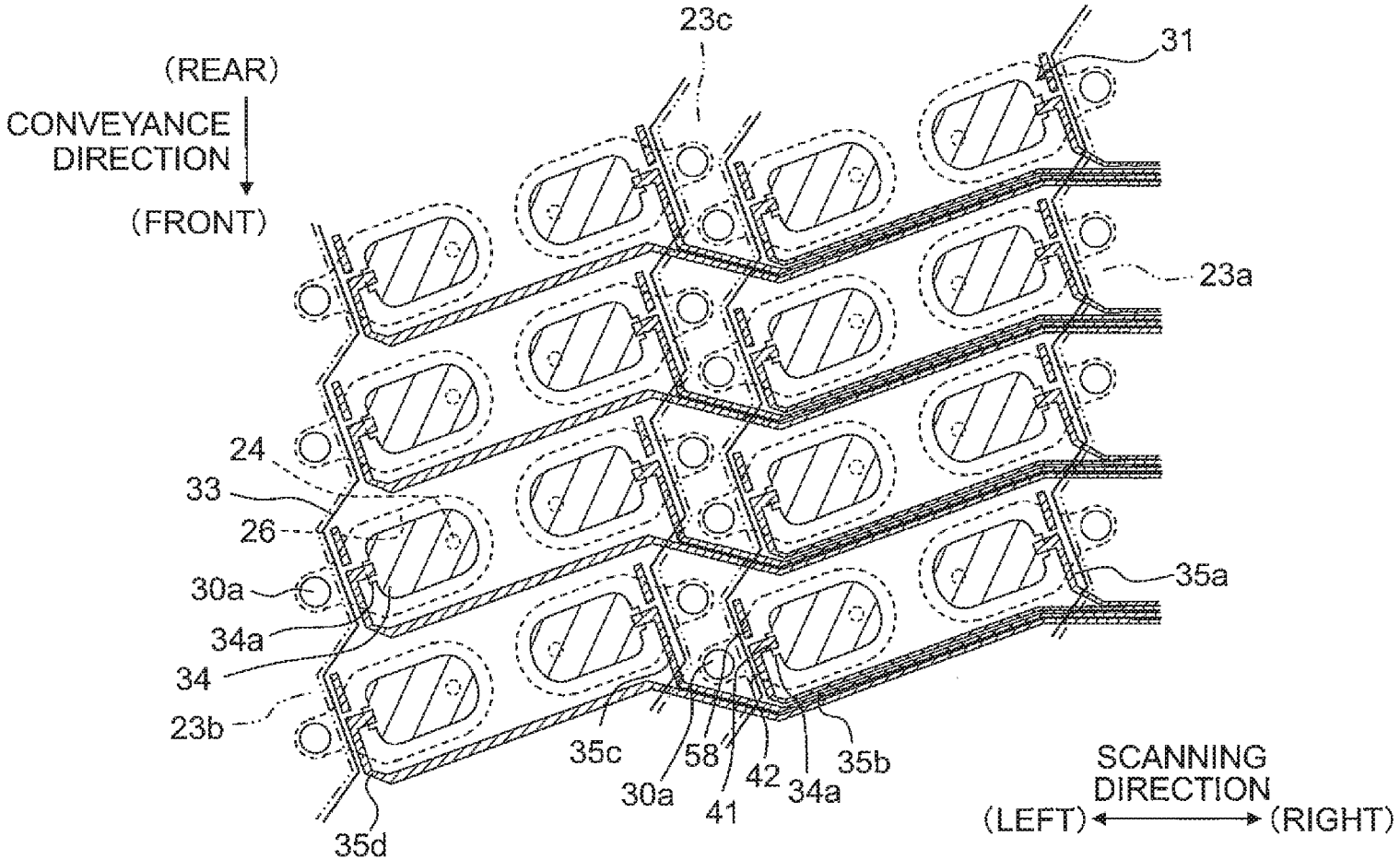
FIG. 7 is a partially enlarged plan view of a head unit according to another modification.

(b) In the above embodiment, the electroconductive portions (the third parts 43) are arranged symmetrically with the second parts 42 across the first parts 41 and connect with the first parts 41 and the second parts 42. However, as depicted in FIG. 7, electroconductive portions 58 are arranged symmetrically with the second parts 42 across the first parts 41 but may not connect with the first parts 41 and the second parts 42. In this configuration, too, because the second parts 42 and the electroconductive portions 58 are arranged symmetrically across the first parts 41, such a force is suppressed as to act on the connecting portions 34*a* due to a non-uniform deformation of the vibration film 30.

Figure 8:
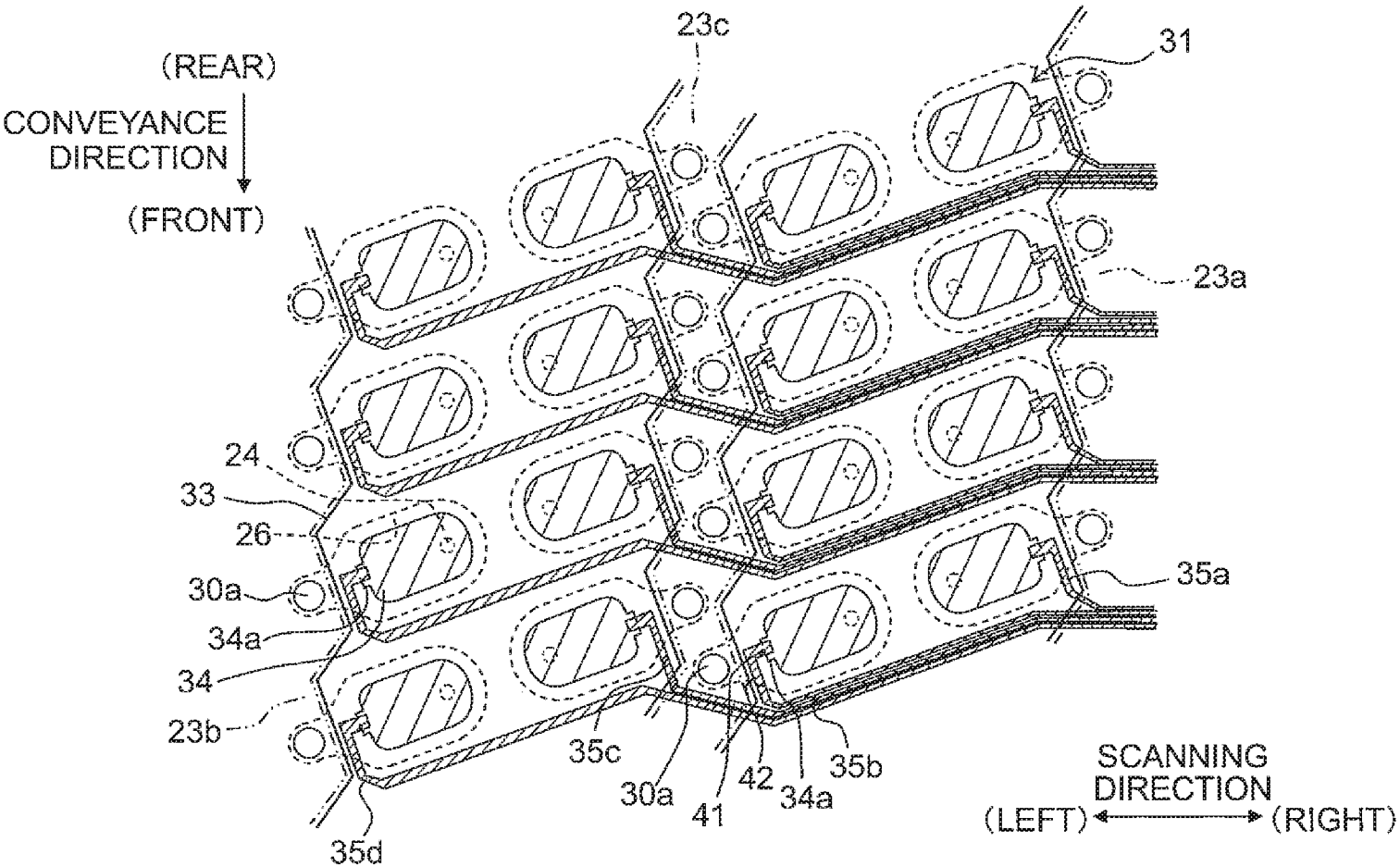
FIG. 8 is a partially enlarged plan view of a head unit according to still other modification.

(c) As depicted in FIG. 8, the traces 35 may have only the first parts 41 and the second parts 42 but not have the electroconductive portions 58 provided in symmetric positions with the second parts 42 across the first parts 41.

Figure 9:
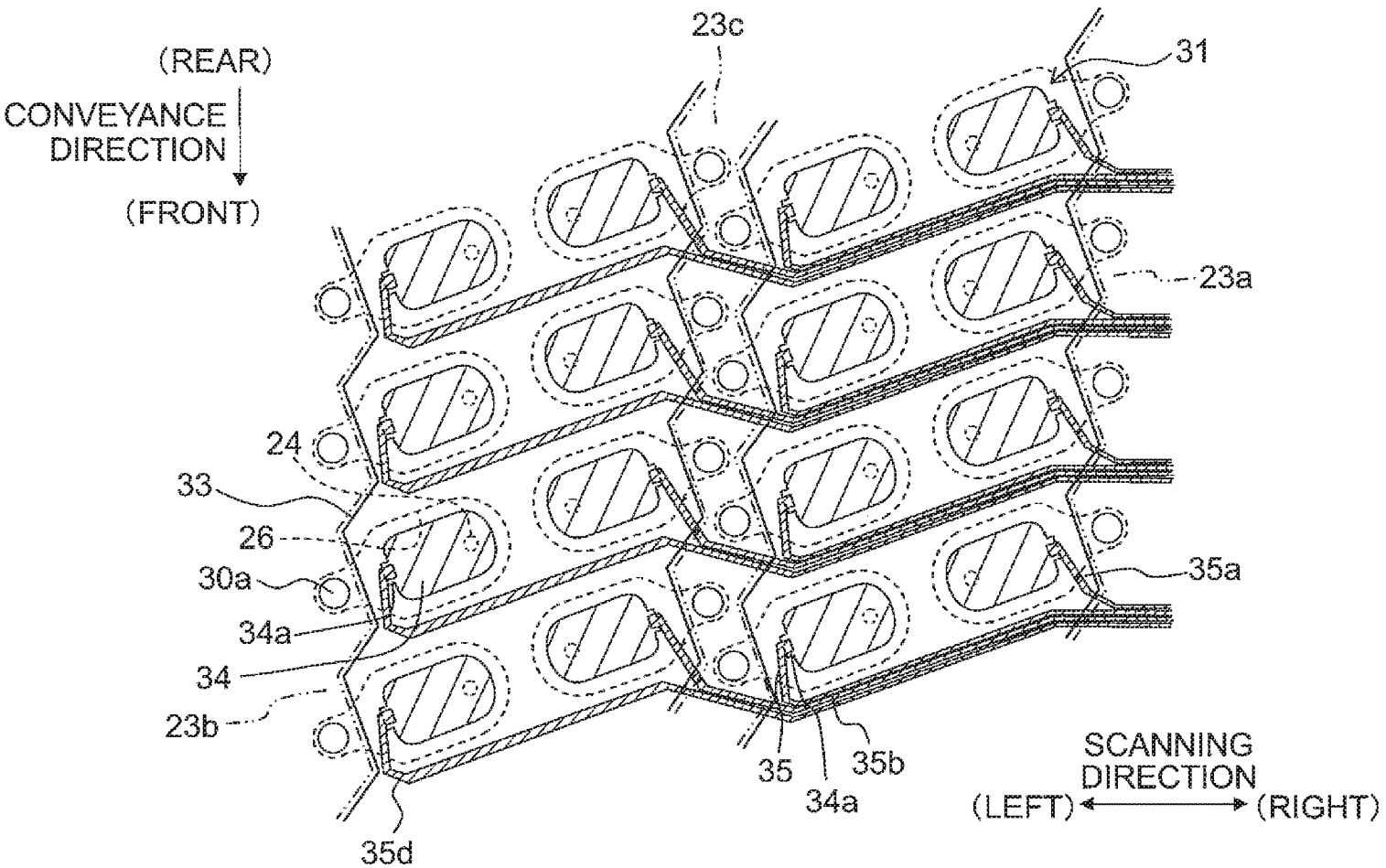
FIG. 9 is a partially enlarged plan view of a head unit according to still another modification.

(d) The traces 35 may be configured not to have the first parts 41 extending from the connecting portions 34*a* in the longitudinal direction of the pressure chambers 26. That is, as depicted in FIG. 9, the traces 35 may extend from the connecting portions 34*a* to the outer side of the pressure chambers 26 in a direction intersecting the longitudinal direction of the pressure chambers 26. In this configuration, too, the traces 35 extend in the direction intersecting the longitudinal direction of the pressure chambers 26, and thus need not bypass the ink supply holes 30*a*, thereby allowing the traces to be shortened. Further, the traces 35 are arranged in a longitudinal outer region of pressure chambers 26 from the connecting portions 34*a*, that is, in a region where the vibration film 30 undergoes a comparatively small flexural deformation; therefore, the reliability in electrical connection is improved between the traces 35 and the connecting portions 34*a* of the individual electrodes 34.

2] In the above embodiment as depicted in FIG. 3, as viewed from the conveyance direction, there is an overlapped arrangement of the ink supply holes 30*a* in communication with the pressure chambers 26*b* belonging to the pressure chamber row 27*b*, and the ink supply holes 30*a* in communication with the pressure chambers 26*c* belonging to the pressure chamber row 27*c*. However, these two sets of the ink supply holes 30*a* may not be overlapped.

3] In the above embodiment, the end portions 28 of the pressure chambers 26 are formed into a tapered shape smaller in width than the central portions of the pressure chambers 26 to communicate with the in supply holes 30*a* of the vibration film 30. In contrast to this, the end portions of the pressure chambers 26 may have the same width as the central portions. That is, the pressure chambers 26 may have a rectangular planar shape.

Figure 10:
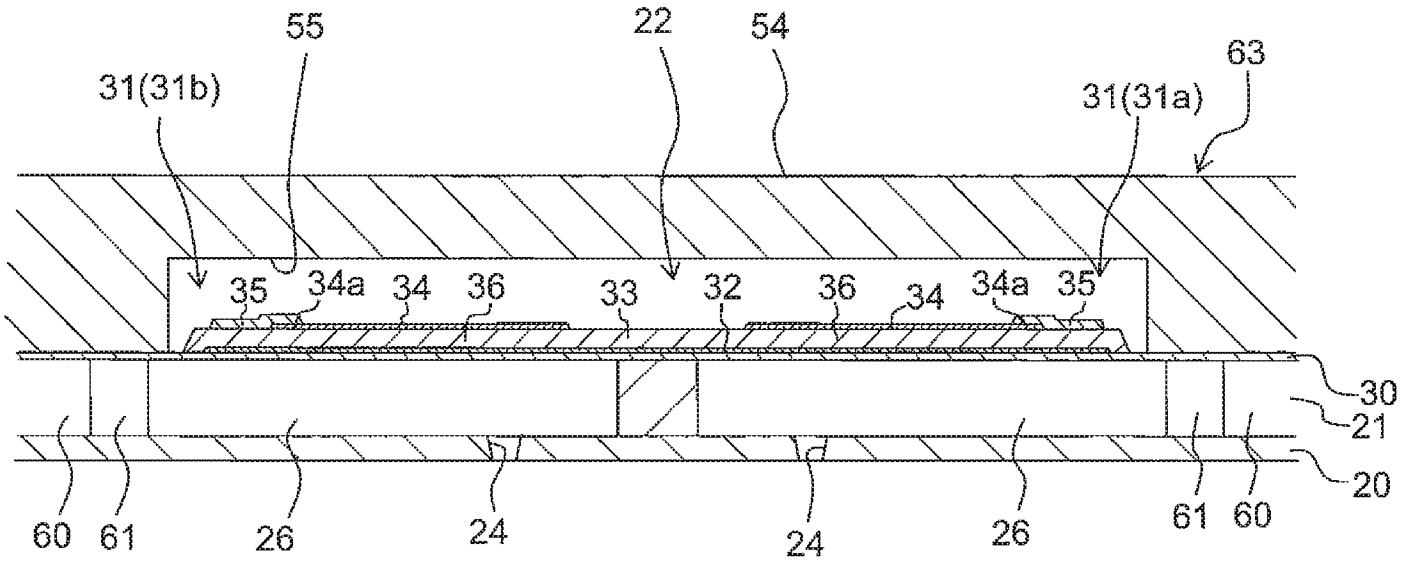
FIG. 10 is a cross-sectional view of a head unit according to still another modification and corresponding to FIG. 4.

4] In the above embodiment, it is configured to form the ink supply holes 30*a* in the vibration film 30 of the flow passage substrate 21, and supply the inks to the respective pressure chambers 26 from the reservoir formation member 23 positioned above the flow passage substrate 21 via the ink supply holes 30*a*. In contrast to this, it may be configured not to form the ink supply holes 30*a* in the vibration film 30. As depicted in FIG. 10 for example, it may be configured to supply the inks to the respective pressure chambers 26 from two manifolds 60 formed in the flow passage substrate 21 on opposite sides of two pressure chamber rows 27 via ink supply flow passages 61.

5] In the above embodiment, the respective pressure chambers 26 are arranged obliquely to the conveyance direction and the scanning direction. As depicted in FIG. 5, however, the present teaching is also applicable to the case where the pressure chambers 26 are arranged for their longitudinal direction to be parallel to the scanning direction.

6] In the above embodiment, one head unit 16 has four nozzle rows 25, four pressure chamber rows 27, and four piezoelectric element rows 37. However, without being limited to such a configuration, it is possible to apply the present teaching as long as the number of each of the rows is at least two.

7] In the above embodiment, the common electrodes 32 are arranged under the piezoelectric bodies 33 (the piezoelectric films) while the individual electrodes 34 are arranged above the piezoelectric bodies 33. However, it is also possible to apply the present teaching to a configuration of arranging the individual electrodes 34 under the piezoelectric bodies 33 while arranging the common electrodes 32 above the piezoelectric bodies 33.

8] In the above embodiment, the piezoelectric films are arranged to link one another for the plurality of pressure chambers 26 forming the two pressure chamber rows 27*a* and 27*b* (or the two pressure chamber rows 27*c* and 27*d*). However, the piezoelectric films may be provided individually according to each of the pressure chambers 26. That is, the piezoelectric films may be separated among the plurality of piezoelectric elements 31.

The embodiment and its modifications explained above have applied the present teaching to a piezoelectric actuator of an ink jet head configured to print image and the like by jetting ink to recording paper. However, it is also possible to apply the present teaching to any liquid jetting apparatuses used for various purposes other than printing image and the like. For example, it is also possible to apply the present teaching to liquid jetting apparatuses which jet an electroconductive liquid to a substrate to form an electroconductive pattern on a surface of the substrate.

What is claimed is:

1. A liquid jetting apparatus comprising:

a flow passage structure having nozzles aligned in a first direction, pressure chambers aligned in the first direction to correspond respectively to the nozzles, and a vibration film covering the pressure chambers;

piezoelectric elements arranged on the vibration film of the flow passage structure to correspond respectively to the pressure chambers; and traces extending along a planar direction of the vibration film of the flow passage structure to correspond respectively to the piezoelectric elements, wherein each of the pressure chambers is formed in a shape elongated in a second direction intersecting the first direction such that each of the pressure chambers is longer in the second direction than the first direction, liquid supply holes for supplying liquid respectively to the pressure chambers are formed in portions, of the vibration film, covering end portions of the pressure chambers on one side in the second direction respectively, each of the piezoelectric elements has a piezoelectric film arranged to cover one of the pressure chambers, and an individual electrode provided on the piezoelectric film to face a central portion of the one of the pressure chambers and extending in the second direction, each of the traces corresponding to one of the piezoelectric elements is superimposed on a connecting portion provided in an end portion, of the individual electrode, on the one side in the second direction to be electrically connected with the individual electrode, and within each area, of the vibration film, facing one of the pressure chambers and disposed on the one side in the second direction with respect to the connecting portion, each of the traces extends from the connecting portion toward an outer side of the area along a third direction intersecting the second direction, wherein within the area of the vibration film, each of the traces has a first part extending from the connecting portion to the one side in the second direction, a second part extending from the first part toward the outer side of the area along the third direction, and a third part arranged symmetrically with the second part with respect to the first part.

2. The liquid jetting apparatus according to claim 1, wherein each of the third parts is connected with the second part of one of the traces.

3. A liquid jetting apparatus comprising:

a flow passage structure having nozzles aligned in a first direction, pressure chambers aligned in the first direction to correspond respectively to the nozzles, and a vibration film covering the pressure chambers;

piezoelectric elements arranged on the vibration film of the flow passage structure to correspond respectively to the pressure chambers; and traces extending along a planar direction of the vibration film of the flow passage structure to correspond respectively to the piezoelectric elements, wherein each of the pressure chambers is formed in a shape elongated in a second direction intersecting the first direction, liquid supply holes for supplying liquid respectively to the pressure chambers are formed in portions, of the vibration film, overlapping end portions of the pressure chambers on one side in the second direction respectively, each of the piezoelectric elements has a piezoelectric film arranged to cover one of the pressure chambers, and an individual electrode provided on the piezoelectric film to face a central portion of the one of the pressure chambers and extending in the second direction, each of the traces corresponding to one of the piezoelectric elements is superimposed on a connecting portion provided in an end portion, of the individual electrode, on the one side in the second direction to be electrically connected with the individual electrode, within each area, of the vibration film, facing one of the pressure chambers and disposed on the one side in the second direction with respect to the connecting portion, each of the traces extends from the connecting portion toward an outer side of the area along a third direction intersecting the second direction.

4. A liquid jetting apparatus comprising:

a flow passage structure having nozzles aligned in a first direction, pressure chambers aligned in the first direction to correspond respectively to the nozzles, and a vibration film covering the pressure chambers;

piezoelectric elements arranged on the vibration film of the flow passage structure to correspond respectively to the pressure chambers; and traces extending along a planar direction of the vibration film of the flow passage structure to correspond respectively to the piezoelectric elements, wherein each of the pressure chambers is formed in a shape having maximum length in a second direction intersecting the first direction, liquid supply holes for supplying liquid respectively to the pressure chambers are formed in portions, of the vibration film, covering end portions of the pressure chambers on one side in the second direction respectively, each of the piezoelectric elements has a piezoelectric film arranged to cover one of the pressure chambers, and an individual electrode provided on the piezoelectric film to face a central portion of the one of the pressure chambers and extending in the second direction, each of the traces corresponding to one of the piezoelectric elements is superimposed on a connecting portion provided in an end portion, of the individual electrode, on the one side in the second direction to be electrically connected with the individual electrode, and within each area, of the vibration film, facing one of the pressure chambers and disposed on the one side in the second direction with respect to the connecting portion, each of the traces extends from the connecting portion toward an outer side of the area along a third direction intersecting the second direction.

5. A liquid jetting apparatus comprising:

a flow passage structure having nozzles aligned in a first direction, pressure chambers aligned in the first direction to correspond respectively to the nozzles, and a vibration film covering the pressure chambers;

piezoelectric elements arranged on the vibration film of the flow passage structure to correspond respectively to the pressure chambers; and traces extending along a planar direction of the vibration film of the flow passage structure to correspond respectively to the piezoelectric elements, wherein each of the pressure chambers is fanned in a shape elongated in a second direction intersecting the first direction, liquid supply holes for supplying liquid respectively to the pressure chambers are formed in portions, of the vibration film, covering end portions of the pressure chambers on one side in the second direction respectively, each of the piezoelectric elements has a piezoelectric film arranged to cover one of the pressure chambers, and an individual electrode provided on the piezoelectric film to face a central portion of the one of the pressure chambers and extending in the second direction, each of the traces corresponding to one of the piezoelectric elements is superimposed on a connecting portion provided in an end portion, of the individual electrode, on the one side in the second direction to be electrically connected with the individual electrode, the connecting portion being disposed within an inner periphery of the one of the pressure chambers when viewed from a direction orthogonal to the planar direction of the vibration film, and within each area, of the vibration film, facing one of the pressure chambers and disposed on the one side in the second direction with respect to the connecting portion, each of the traces extends from the connecting portion toward an outer side of the area along a third direction intersecting the second direction.

6. The liquid jetting apparatus according to claim 5, wherein within the area of the vibration film, each of the traces has a first part extending from the connecting portion to the one side in the second direction and a second part extending from the first part toward the outer side of the area along the third direction.

7. The liquid jetting apparatus according to claim 5, wherein in each of the pressure chambers, an end portion on the one side in the second direction is smaller in width than the central portion in the second direction.

8. The liquid jetting apparatus according to claim 5, further comprising a junction member joined to an area, of the flow passage structure, on the one side in the second direction with respect to the traces.

9. The liquid jetting apparatus according to claim 5, wherein the individual electrodes and the traces are formed of different electroconductive materials.

10. The liquid jetting apparatus according to claim 5, wherein each of the traces extends toward the outer side of the area along the third direction between the connecting portion and one of the liquid supply holes in the second direction.

* * * * *